US007621438B2

(12) United States Patent
Spivey, Sr.

(10) Patent No.: US 7,621,438 B2
(45) Date of Patent: Nov. 24, 2009

(54) CARTON HAVING OPENING AND POSITIONING FEATURES

(75) Inventor: Raymond Rudolph Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 722 days.

(21) Appl. No.: 11/054,629

(22) Filed: Feb. 9, 2005

(65) Prior Publication Data

US 2005/0178687 A1 Aug. 18, 2005

Related U.S. Application Data

(60) Provisional application No. 60/543,382, filed on Feb. 10, 2004.

(51) Int. Cl.
*B65D 5/54* (2006.01)

(52) U.S. Cl. ..... 229/104; 206/45.25; 206/762; 229/122.1; 229/242

(58) Field of Classification Search ..... 229/104, 229/122, 122.1, 242; 206/45.25, 427, 762; 221/302, 305; *B65D 5/54*
See application file for complete search history.

(56) References Cited

U.S. PATENT DOCUMENTS

| | | | | |
|---|---|---|---|---|
| 902,347 A | | 10/1908 | Tillinghast | |
| 1,301,201 A | * | 4/1919 | Walker | 206/45.25 |
| 1,434,165 A | * | 10/1922 | Ten | 206/45.26 |
| 1,480,199 A | * | 1/1924 | Durick et al. | 206/45.25 |
| 1,541,143 A | | 6/1925 | Hoile | 229/231 |
| 1,548,254 A | * | 8/1925 | Henry | 206/45.25 |
| 1,925,102 A | | 9/1933 | Levkoff | 206/44 |
| 2,124,808 A | | 7/1938 | White et al. | 229/27 |
| 2,312,595 A | * | 3/1943 | Smith | 206/45.25 |
| 2,448,819 A | | 9/1948 | Mitchell | 206/57 |
| 2,473,635 A | | 6/1949 | Buttery | 206/45.26 |
| 2,718,301 A | | 9/1955 | Palmer | 206/65 |
| 2,723,027 A | | 11/1955 | Guyer | 206/65 |
| 2,730,232 A | | 1/1956 | Coe | 206/45.26 |

(Continued)

FOREIGN PATENT DOCUMENTS

| | | | |
|---|---|---|---|
| CA | 874828 | 7/1971 | 221/14 |
| CA | 2246020 | 8/1998 | |
| DE | 2 323 589 A | 5/1973 | |
| DE | 75 10 538 | 8/1975 | |
| DE | 76 06 493 U1 | 6/1976 | |

(Continued)

OTHER PUBLICATIONS

"Dispensing Multipack, Coke Canner Rolls Out 'Fridge-Friendly' Pack," Packaging World, Sep. 2001, p. 2, [Summit Publishing Company—Chicago].

(Continued)

*Primary Examiner*—Gary E Elkins
(74) *Attorney, Agent, or Firm*—Womble Carlyle Sandridge & Rice, PLLC

(57) ABSTRACT

A carton is provided for holding and positioning articles for easy access. The carton may also be used for dispensing articles that contain products such as food and beverages. The carton includes various unique features, including an opening feature that provides easy access to the articles, and a tilt feature that positions the articles at the front end of the carton. Also provided is a carton blank, such as a paperboard blank, which is cut to a specific shape, and creased and scored, cut or perforated in specific areas. Methods for forming the blanks into cartons and for operating the opening and positioning features are also described.

45 Claims, 8 Drawing Sheets

U.S. PATENT DOCUMENTS

| | | | | |
|---|---|---|---|---|
| 2,754,047 | A | 7/1956 | Schmidt et al. | 229/51 |
| 2,842,304 | A | 7/1958 | Ringler | 229/51 |
| 2,868,431 | A | 1/1959 | Painter | 229/51 |
| 2,894,672 | A * | 7/1959 | Bamburg | 206/45.26 |
| 2,919,844 | A | 1/1960 | Anderson, Jr. | 229/28 |
| 2,930,516 | A | 3/1960 | Fowle et al. | 229/7 |
| 2,975,891 | A | 3/1961 | Stone | 206/65 |
| 2,990,097 | A | 6/1961 | Thompson | 229/20 |
| 3,002,651 | A | 10/1961 | Gauld | 221/34 |
| 3,018,031 | A | 1/1962 | Ahlbor et al. | 229/44 |
| 3,178,242 | A | 4/1965 | Ellis et al. | 312/45 |
| 3,228,582 | A | 1/1966 | Osberg | 229/51 |
| 3,263,861 | A | 8/1966 | Carr | 221/302 |
| 3,265,283 | A | 8/1966 | Farquhar | 229/27 |
| RE26,083 | E | 9/1966 | Forrer | 220/115 |
| 3,300,115 | A | 1/1967 | Schauer | 229/27 |
| 3,332,594 | A | 7/1967 | Capua | 224/15 |
| 3,356,279 | A | 12/1967 | Root | 229/17 |
| 3,517,858 | A | 6/1970 | Farquhar | 221/305 |
| 3,540,581 | A | 11/1970 | Koolnis | 206/193 |
| 3,599,858 | A | 8/1971 | Samsing | 229/51 |
| 3,669,251 | A | 6/1972 | Phillips | 206/44 |
| 3,765,327 | A | 10/1973 | Vargo | 101/232 |
| 3,765,527 | A | 10/1973 | Vargo | 206/44 |
| 3,894,681 | A | 7/1975 | Arneson et al. | 221/305 |
| 3,913,739 | A | 10/1975 | Hennessey | 206/434 |
| 3,942,631 | A | 3/1976 | Sutherland et al. | 206/44.12 |
| 4,000,811 | A | 1/1977 | Hardison et al. | 229/242 |
| D243,508 | S | 3/1977 | Killy | D9/245 |
| 4,030,596 | A | 6/1977 | Snyder et al. | 206/45.26 |
| D252,259 | S | 7/1979 | Rinehart | D9/245 |
| 4,214,660 | A | 7/1980 | Hunt, Jr. | 206/427 |
| 4,216,861 | A | 8/1980 | Oliff | 206/427 |
| 4,222,485 | A | 9/1980 | Focke | 206/141 |
| D263,204 | S | 3/1982 | Dutcher | D9/433 |
| 4,325,482 | A | 4/1982 | Feeser | 206/625 |
| 4,331,231 | A * | 5/1982 | Boyle | 206/45.25 |
| 4,364,509 | A | 12/1982 | Holley, Jr. et al. | 229/95 |
| 4,375,258 | A | 3/1983 | Crayne et al. | 432/141 |
| D269,068 | S | 5/1983 | Mann et al. | D9/416 |
| D270,041 | S | 8/1983 | Vestal | D9/416 |
| 4,396,143 | A | 8/1983 | Killy | 221/305 |
| 4,416,410 | A | 11/1983 | Herrmann | 229/38 |
| 4,417,661 | A | 11/1983 | Roccaforte | 229/232 |
| 4,465,180 | A | 8/1984 | Klygis | 206/158 |
| 4,498,581 | A | 2/1985 | Dutcher | 206/427 |
| 4,582,199 | A | 4/1986 | Schuster | 206/428 |
| D286,987 | S | 12/1986 | Golan et al. | D9/433 |
| 4,726,471 | A | 2/1988 | Whately et al. | 206/554 |
| 4,756,419 | A | 7/1988 | Le Bras | 206/430 |
| 4,785,991 | A | 11/1988 | Schuster | 229/52 |
| 4,817,866 | A | 4/1989 | Wonnacott | 206/427 |
| D303,090 | S | 8/1989 | Armor et al. | D9/433 |
| 4,860,944 | A | 8/1989 | Wonnacott | 229/52 |
| 4,919,266 | A | 4/1990 | McIntosh, Jr. et al. | 206/434 |
| 4,966,324 | A | 10/1990 | Steel | 229/117.13 |
| 4,972,991 | A | 11/1990 | Schuster | 229/117.13 |
| 4,974,771 | A | 12/1990 | Lavery | 229/117.13 |
| 4,981,253 | A | 1/1991 | Quaintenance | 229/117.13 |
| 5,002,186 | A | 3/1991 | Cooper | 206/433 |
| 5,031,825 | A | 7/1991 | Romagnoli | 229/160.1 |
| 5,067,615 | A | 11/1991 | Davitian | 229/230 |
| 5,101,642 | A | 4/1992 | Alexandrov | 62/371 |
| 5,123,589 | A | 6/1992 | Cote | 229/232 |
| 5,137,211 | A | 8/1992 | Summer et al. | 229/164 |
| 5,170,934 | A | 12/1992 | Lemoine | 229/101 |
| D332,915 | S | 2/1993 | Hoell et al. | D9/346 |
| 5,277,360 | A | 1/1994 | DeMott | 229/122 |
| 5,279,440 | A | 1/1994 | Fougeres et al. | 220/228 |
| 5,284,292 | A | 2/1994 | Johnson | 229/122.1 |
| 5,333,734 | A | 8/1994 | Stout et al. | 206/427 |
| 5,368,194 | A | 11/1994 | Oliff et al. | 221/305 |
| 5,427,242 | A | 6/1995 | Oliff et al. | 206/430 |
| 5,465,831 | A | 11/1995 | Smith | 206/44 |
| 5,505,372 | A | 4/1996 | Edson | 229/121 |
| 5,518,111 | A | 5/1996 | Stout | 206/160 |
| 5,622,309 | A | 4/1997 | Matsuda et al. | 229/243 |
| 5,722,584 | A | 3/1998 | Fujiwara | 229/120.15 |
| 5,775,574 | A | 7/1998 | Whitnell | 229/120.18 |
| 5,788,117 | A | 8/1998 | Zimmanck | 221/285 |
| 5,826,783 | A | 10/1998 | Stout | 229/120.32 |
| 5,833,118 | A | 11/1998 | Weiss | 221/309 |
| 5,873,515 | A | 2/1999 | Dunn et al. | 229/117.13 |
| 5,878,947 | A | 3/1999 | Hoy et al. | 229/122.1 |
| 5,881,884 | A | 3/1999 | Podosek | 206/774 |
| 6,105,854 | A | 8/2000 | Spivey | 229/122.1 |
| D436,859 | S | 1/2001 | Botsford et al. | D9/416 |
| 6,176,419 | B1 | 1/2001 | Holley, Jr. | 229/122.1 |
| 6,283,293 | B1 | 9/2001 | Lingamfelter | 206/427 |
| D454,784 | S | 3/2002 | Oram | D9/416 |
| 6,386,369 | B2 | 5/2002 | Yuhas et al. | 206/746 |
| 6,435,351 | B1 | 8/2002 | Gibb | 206/736 |
| 6,478,219 | B1 | 11/2002 | Holley, Jr. | 229/240 |
| 6,484,903 | B2 | 11/2002 | Spivey et al. | 221/303 |
| 6,550,615 | B2 | 4/2003 | Lingamfelter | 206/427 |
| 6,578,736 | B2 | 6/2003 | Spivey et al. | 221/305 |
| 6,631,803 | B2 | 10/2003 | Rhodes et al. | 206/427 |
| 6,669,083 | B2 | 12/2003 | Bates | 229/240 |
| 6,715,639 | B2 | 4/2004 | Spivey | 221/305 |
| 6,729,475 | B2 | 5/2004 | Yuhas | |
| 6,866,185 | B2 * | 3/2005 | Harrelson | 229/104 |
| 6,902,104 | B2 * | 6/2005 | Holley et al. | 229/242 |
| 6,929,172 | B2 * | 8/2005 | Bates et al. | 229/244 |
| 7,104,435 | B2 | 9/2006 | Holley, Jr. | |
| 2002/0070139 | A1 | 6/2002 | Bates | 206/426 |
| 2003/0141353 | A1 | 7/2003 | Wilson | 229/103.2 |
| 2004/0089671 | A1 | 5/2004 | Miller | |

FOREIGN PATENT DOCUMENTS

| | | | |
|---|---|---|---|
| DE | 29 33 022 | C2 | 8/1979 |
| DE | 30 07 769 | C2 | 2/1980 |
| DE | 81 35 176.3 | | 11/1981 |
| DE | 85 14 718.4 | | 8/1985 |
| DE | 86 29 664.7 | | 11/1986 |
| DE | 3612594 | A1 | 10/1987 |
| DE | 40 23 043 | A1 | 7/1990 |
| DE | 94 12 885.5 | | 8/1994 |
| DE | 94 13 813.3 | | 8/1994 |
| DE | 694 21 620 | T2 | 8/1994 |
| DE | 295 19 931 | U1 | 12/1995 |
| DE | 296 02 010 | U1 | 2/1996 |
| DE | 299 09 008 | U1 | 5/1999 |
| DE | 29913585 | U1 | 8/1999 |
| EP | 235 852 | B1 | 2/1987 |
| EP | 0 323 596 | A1 | 12/1988 |
| EP | 342 088 | B1 | 4/1989 |
| EP | 0 475 147 | A1 | 8/1991 |
| EP | 659 143 | B1 | 6/1994 |
| EP | 752 370 | A2 | 7/1995 |
| EP | 936 995 | B1 | 11/1997 |
| EP | 0849189 | A1 | 6/1998 |
| EP | 1 060 998 | A2 | 6/2000 |
| GB | 2 186 550 | A | 8/1987 |
| GB | 2 189 223 | | 10/1987 |
| JP | 7-9721 | | 7/1993 |
| JP | 2002/166926 | A * | 6/2002 |
| WO | WO 88/09750 | | 6/1988 |
| WO | WO 95/25668 | | 3/1994 |
| WO | WO 96/29260 | | 9/1996 |
| WO | WO 97/21607 | | 6/1997 |
| WO | WO 98/31593 | | 12/1997 |
| WO | WO 99/64301 | | 6/1998 |
| WO | WO 00/23334 | | 10/1999 |

| | | | |
|---|---|---|---|
| WO | WO 00/71428 | A1 | 5/2000 |
| WO | WO 02/04302 | A1 | 7/2000 |
| WO | WO 01/28871 | A1 | 10/2000 |
| WO | WO 02/085739 | A1 | 10/2002 |

OTHER PUBLICATIONS

"Hot Hit With Consumers," International Bottler & Packer, Nov. 2001 [Binstead Publications Ltd.].

"Coke Bottler Tests A Slimmer Soda Package", Wall Street Journal B3 (Aug. 10, 2001).

"Passing the Torch", BeverageWorld p. 36 (Oct. 2002).

"Riverwood" For the Carton Designated as 'Fridge Pack,' International Bottler & Packer, Nov. 2001 [Binstead Publications Limited—United Kingdom].

"Coca-Cola Fridge Mate", p. 3 Revise Woolworth's Advertisement wca4000 / N1A.

* cited by examiner

CARTON HAVING OPENING AND POSITIONING FEATURES

CROSS-REFERENCE TO RELATED APPLICATION

The present application claims priority to U.S. provisional patent application Ser. No. 60/543,382, filed Feb. 10, 2004, which application is incorporated by reference as if set forth herein in its entirety.

FIELD OF THE INVENTION

The present invention generally relates to cartons for holding articles and for positioning those articles for easy access. More specifically, the present invention relates to dispensing cartons having a tilting mechanism for positioning articles within the carton.

BACKGROUND OF THE INVENTION

Enclosed cartons with positioning features for displaying or dispensing articles have been used in the past. Many of these cartons require the user to detach a portion of the carton, manipulate the portion to fashion a positioning assembly, and place the assembly under the carton. Other types of cartons include positioning features that require adhesives to hold the positioning assembly in place or to adhere the positioning assembly to the carton, while still other cartons with attached positioning features require the user to insert the positioning assembly into preformed slots in the carton. In many instances, after the user engages the positioning assembly, the structural integrity of the carton is destroyed, and once the positioning feature is removed from the carton, the user generally cannot reclose the carton. Furthermore, many conventional carton positioning assemblies are structurally weak, and are easily flattened by excessive weight.

SUMMARY OF THE INVENTION

The present invention generally relates to a carton with a positioning assembly for holding and positioning articles for easy access, and a method of positioning such a carton. The present invention can be used, for example, in dispensing articles that contain products such as food and beverages. These articles can include beverage containers such as cans, bottles and PET containers, as well as other containers preferably being round in shape, such as those used in packaging foodstuffs or non-foodstuff items. In one aspect of the present invention, a carton is provided with a positioning assembly that can be positioned easily without the use of adhesives. In another aspect of the present invention, a carton is provided with a positioning assembly that can be reclosed after engagement of the positioning assembly. In a further aspect of the present invention, a carton is provided with a positioning assembly that does not require the user to detach a portion of the carton.

The invention also includes a carton blank, such as a paperboard blank, which is cut to a specific shape, then creased and scored, cut, or perforated in specific areas. The carton blank defines elongate panels between the creases or fold lines, and includes dust flaps at the respective ends of the panels. The carton blank is folded to form a sleeve, and when fully assembled, with the end flaps closed, the assembled carton has a front or forward end, a rearward end, and a top wall, a bottom wall, front and rear walls, and first and second side walls.

For purposes of illustration, the present invention is disclosed as a paperboard carton, sized and dimensioned to contain beverages in PET bottles, or cans of beverages. The carton illustrated in the drawing figures is sized to hold twelve articles in a 2×6 configuration, although the present invention is not limited to any specific size or dimension. For example, the present invention also would work satisfactorily if sized and shaped to hold articles in other configurations, such as 3×4, 2×4, 2×5, etc. The carton includes various unique features, including an opening feature that provides easy access to the articles, and a positioning assembly that positions the articles at the front end.

DETAILED DESCRIPTION OF THE INVENTION

Figure 1:
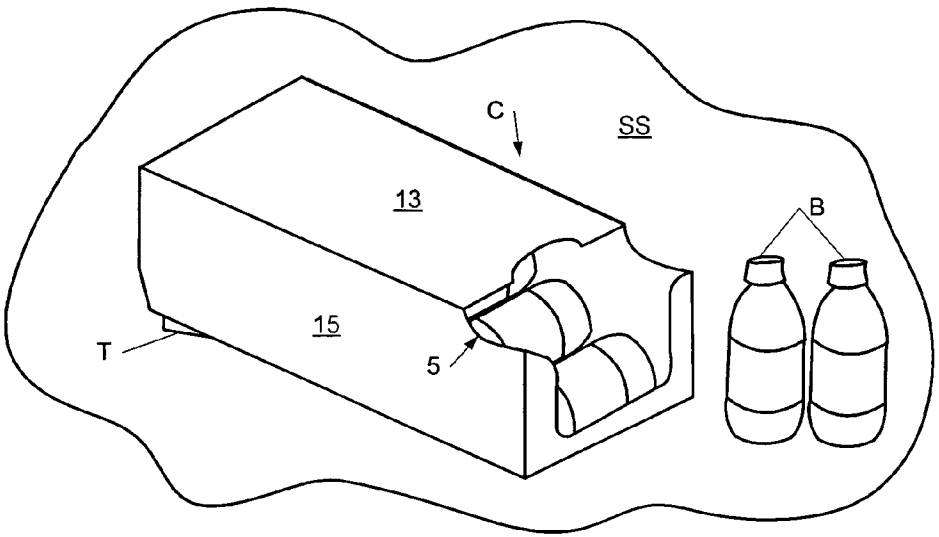
FIG. 1 is a perspective view of the carton containing PET bottles showing the opening flap removed and the tilt assembly in its operable position.

For a more complete understanding of the present invention, reference should be made to the following detailed description and accompanying drawings, wherein like reference numerals designate corresponding parts throughout the figures.

To facilitate understanding and explanation of the carton of the present invention, the elements and numerals described herein will utilize the terms "upper," "lower," "top," "bottom," "front," and "back" to distinguish portions of the halves of the carton and of the blank. These conventions are included merely for ease of explanation and understanding of the present description, however, and should not be limiting in any manner. For example, the descriptions of the panels as "upper," "lower," etc., also can be referred to as "first," "second," etc.

The tear lines can be continuous and can be comprised of any combination of perforations, tears, scores, creases, folds, cut scores, tear lines, or any combination of these or other inclusions formed in the container blank.

FIG. 1 is a perspective view of a carton C in accordance with one embodiment of the present invention with the opening flap removed. The positioning assembly in the illustrated embodiment of the invention comprises a tilt assembly T, which is shown in its operable position. Two tubular-shaped PET beverage bottles are positioned on a support surface SS beside the opening end or front end 5 of the carton in FIG. 1. The tilt assembly T is positioned at the rearward end 6 of carton C.

Figure 2:
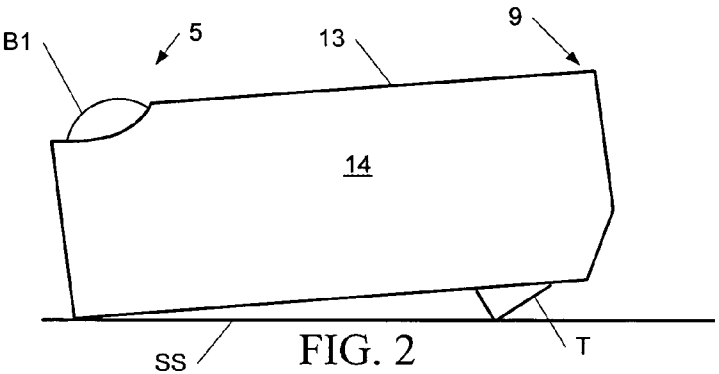
FIG. 2 is a side view of the carton of FIG. 1, containing PET bottles in a 2×6 arrangement.

FIG. 2 is a side view of the carton of FIG. 1. In FIG. 2, the PET bottles B are contained in the carton in a 2×6 arrangement, with each bottle in the top row being positioned directly above a corresponding bottle in the bottom row. The first bottle B1 in the upper row of PET bottles is visible at the opening end or front end 5.

Figure 3:
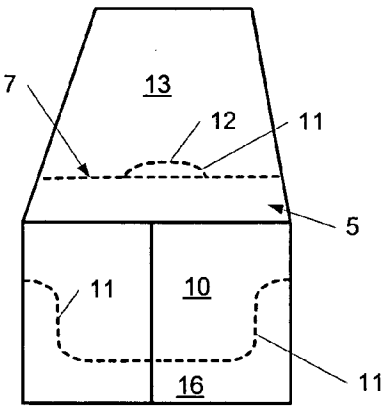
FIG. 3 is an end view of the carton containing containers with the dispenser fully connected to the remainder of the carton.

FIG. 3 is an end view of the carton C with the dispenser 7 fully connected to the remainder of carton C so that two rows of six PET bottles are contained within the fully enclosed carton. The dispenser 7 shown in FIG. 3 includes opening flap 10 defined by a demarcation line 11. This demarcation line can be a cut line, score line, or other weakened area, which allows a user to manually separate the dispenser 7 from the carton along the line 11, and remove the dispenser 7 from the remainder of the carton C. The opening flap 10 optionally also may define a finger flap 12 along one of the carton walls. The finger flap 12 can be included to assist a user in initiating the opening of the carton by pushing inwardly on the finger flap 12 to break the carton along line 11. Preferably, the finger flap 12 is located on the top wall 13 of the carton, although the present invention could be configured to allow one or more finger flaps located on other walls, such as one or both of the side walls 14 and 15 or the front wall 16.

Figure 4:
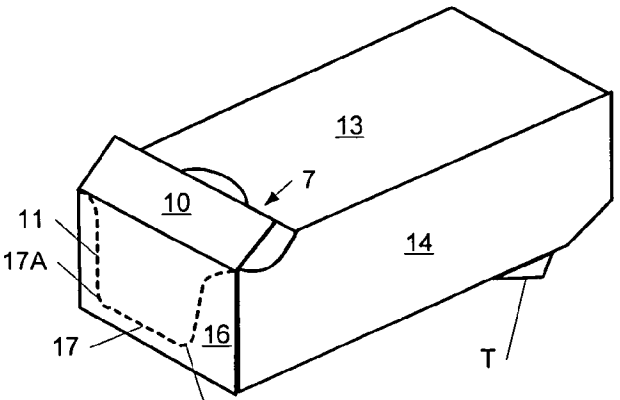
FIG. 4 is a perspective view of the carton containing containers illustrating the opening of the dispenser.
Figure 5:
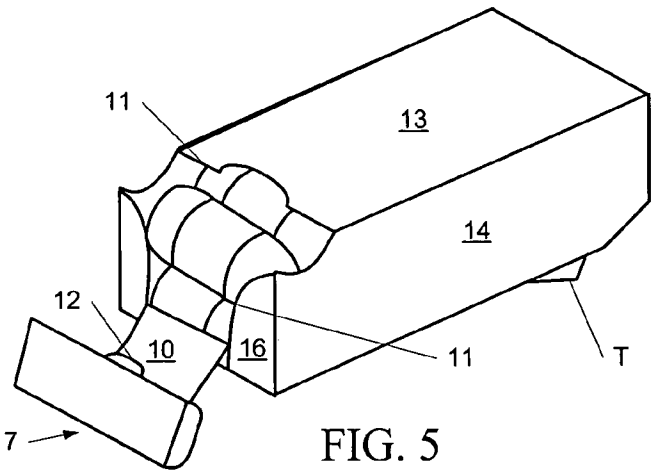
FIG. 5 is a perspective view of the carton containing PET bottles showing the dispenser opened but attached to the remainder of the carton.

FIG. 4 shows a fully enclosed carton C that holds PET bottles, and illustrates the removal of dispenser 7. The user pushes one or more fingers inwardly to open the carton C, initially along the portion of the line 11 that defines finger flap 12. The user then pulls outwardly on flap 12 and on flap 10, away from the remainder of the carton to begin separating the opening flap 10 from the remainder of carton C along the demarcation line 11. Even if finger flap 12 is not incorporated, the opening process usually begins along the portion of the line 11 defined in the top wall 13 of the carton. As the opening flap 10 continues to be pulled, the flap 10 also separates along the line 11 defined in first side wall 14 and second side wall 15. Continued pulling on the flap 10 will begin to separate flap 10 from the front wall 16, as shown in FIG. 5. At this point the dispenser 7, a unitary structure, can either remain attached to the carton as shown in FIG. 5, forming a basket, or optionally can be removed entirely from the carton by pulling along demarcation line portion 17, which extends along opening end or front end 5 approximately from point 17A to point 17B. Portion 17 generally is spaced above the bottom panel of the carton a distance less than the diameter of one of the containers held in the carton, this distance being sufficient to prevent the containers from rolling out of the carton while the dispenser is open and to preserve the structural integrity of the carton.

Figure 6:
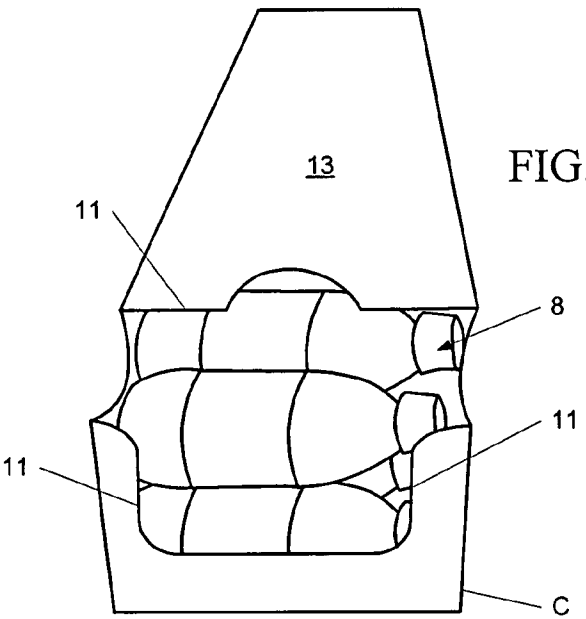
FIG. 6 is an end view of the carton containing PET bottles in a 2×6 arrangement with the dispenser removed.

FIG. 6 shows the carton C holding PET bottles B in a 2×6 arrangement with opening flap 10 removed from the carton. An access opening 8 is defined by the edges of the top wall 13, side walls 14 and 15 and front wall 16 as outlined by demarcation line 11. The containers or bottles held in the carton do not dispense automatically, but are positioned at the front end of the carton for ready individual removal by grasping the forward-most container in the carton at the access opening 8.

Preferably, the articles in the carton are tubular, having round side walls, such as cans and bottles, so that the articles roll forwardly when the tilt assembly is engaged as discussed below. The carton of the present invention is ideally suited for holding beverage cans, PET bottles and food stuff containers such as rolls, biscuits, etc. Any other containers in other configurations holding non-food items, such as motor oil, can be held and automatically positioned in the present carton.

The carton can also include a tilt assembly T that can be engaged, that is, placed in its operable position, to elevate the rearward end 9 of the carton. When the tilt assembly T is engaged, the carton's rearward end 9 is elevated above the supporting surface SS, such as the counter, refrigerator shelf or cabinet or shelf supporting the carton. When the carton is manually placed in this elevated position, the tubular containers will roll forwardly from the rearward end 9 toward the opening end or front end 5 by gravity, so that the containers are positioned to allow the user to reach into the carton through the access opening 8, and easily remove them.

Figure 7:
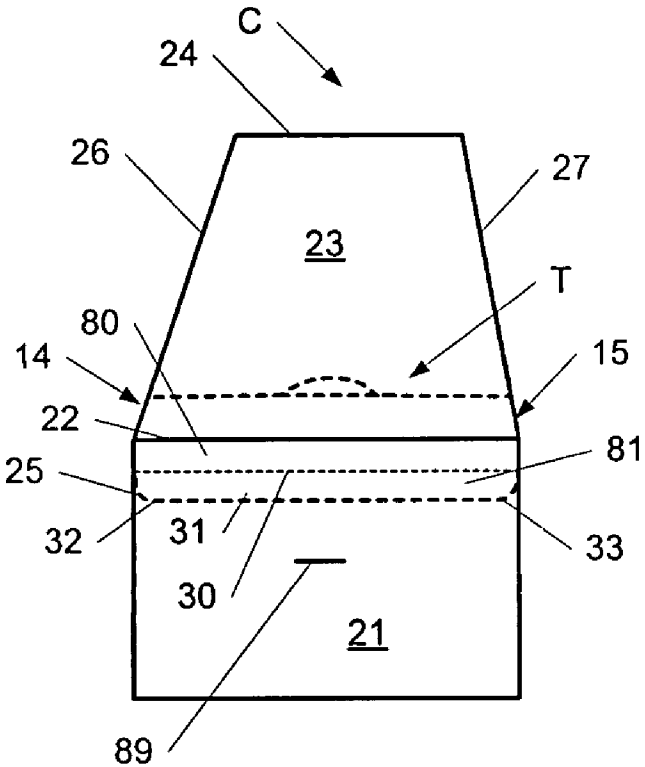
FIG. 7 is an end bottom view of the rearward end of the carton showing the tilt assembly fully connected to the remainder of the carton.

FIG. 7 is an end view of the rearward end 9 of the carton C, viewed from behind and below the carton. The bottom wall 21 terminates along score line 22, which preferably is a cut score line. The carton's rear wall 23 extends from cut line 22 upwardly to top edge 24, where the rear wall 23 meets the top wall 13. The tilt assembly T of carton C is defined by various preformed lines, including perforated lines, solid crease lines, cut crease lines and cut score lines. Those skilled in the art, however, will understand that, although the tilt assembly T of the present invention works well using the lines as described herein, other combinations of these lines could be substituted for the specific combinations described herein.

Figure 8:
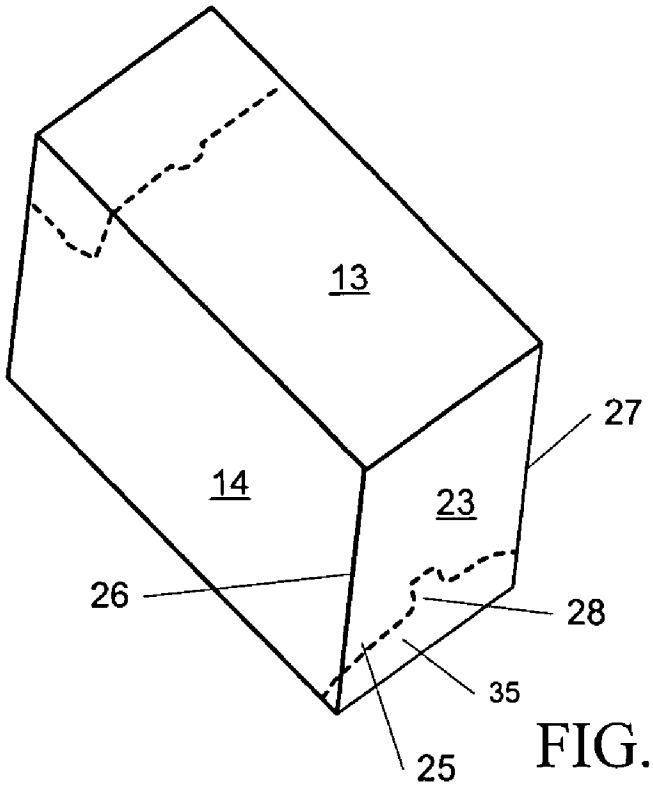
FIG. 8 is a perspective top view of the rearward end of the carton showing the tilt assembly fully connected to the remainder of the carton.

As shown in FIG. 7, perforated line 25 extends from point 32 across bottom wall or panel 21 to side wall 14. FIG. 8 shows line 25 continuing across the lower, rear corner of side wall 14 upwardly toward the carton edge 26 where side wall 14 meets rear wall 23. Line 25 then extends across rear wall 23 to the opposite carton edge 27, where rear wall 23 meets side wall 15. The distance between line 25 and bottom wall 21 is less than the diameter of one of the containers held in the carton, though other heights are possible. A tab or finger flap 28 optionally can be defined in rear wall 23 by perforated line 25, as shown in FIG. 8. The line 25 extends in identical fashion across the lower, rear corner of side wall 15 to bottom wall 21, and then to point 33, shown in FIG. 7.

Referring again to FIG. 7, score line 22 is formed along the carton edge that joins rear wall 23 and bottom wall 21. Spaced along bottom wall 21 forwardly from score line 22 is cut fold line 30, as shown in FIG. 7. A rectangular panel 80 is defined between lines 22 and 30. Also shown in FIG. 7 is solid fold line 31, which extends spaced from and forwardly of line 30 along bottom wall 21 from point 32 to point 33. Fold line 30 is equidistant between lines 22 and 31. A panel 81 having angled end portions (FIG. 7) is defined between lines 30 and 31. The angled end portions of panel 81 are defined by the portions of perforated line 25, which extend from point 32 to side wall 14, and from point 33 to side wall 15. A tilt flap 35, which includes panels 80 and 81, is defined between lines 25 and 31.

Figure 10:
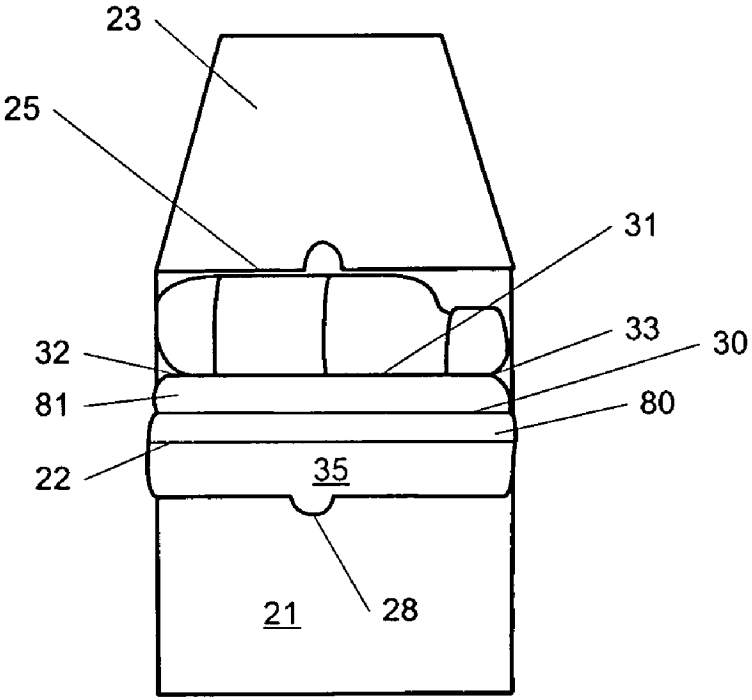
FIG. 10 is an end bottom view of the rearward end of the carton containing PET bottles in a 2×6 arrangement with the tilt assembly pulled downward.

In order to position the tilt assembly T, tilt flap 35 is pulled downwardly by pushing inwardly along tab or finger flap 28 and pulling outwardly, away from carton C, in order to begin tearing rear wall 23 along perforated line 25. At this point, the user will lift the rear end of the carton so that it is elevated from the support surface SS, such as a counter or shelf, high enough to allow flap 35 to be moved beneath bottom wall 21. This allows the tilt flap 35 to be tom across the lower, rear corners of side walls 14, 15, and along perforated line 25 in bottom wall 21 down to points 32 and 33, as shown in FIG. 10. The tilt assembly T then constitutes a unitary structure that is hingedly attached to the carton along line 31, and that preserves the structural integrity of the carton.

The tilt assembly T as shown in the figures includes penetrations on tear lines in the side panels. However, the tilt assembly T need not include portions of either or both side panels, but such are shown in the figures for consistency and ease of illustration herein.

Figure 9C:
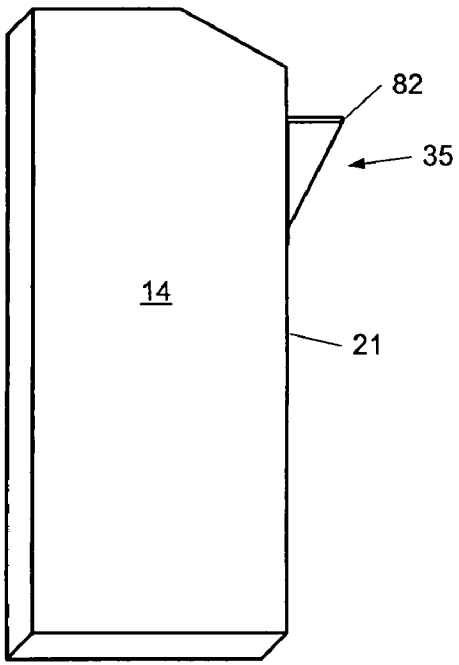
FIGS. 9A to 9C are side views of the carton illustrating the steps in properly positioning the tilt assembly in its operable position.
Figure 9B:
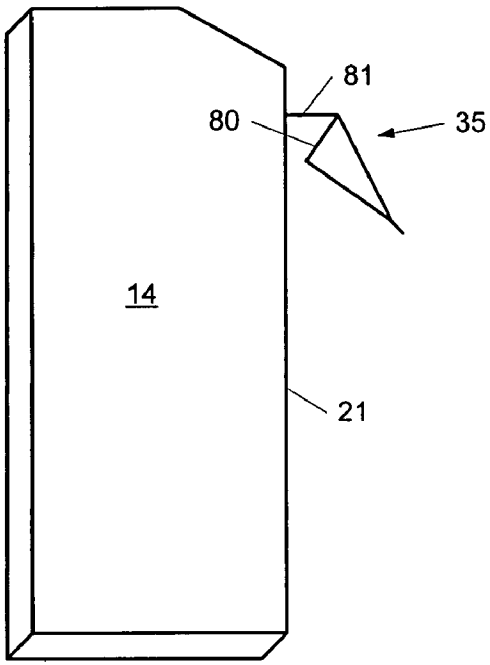
Figure 9A:
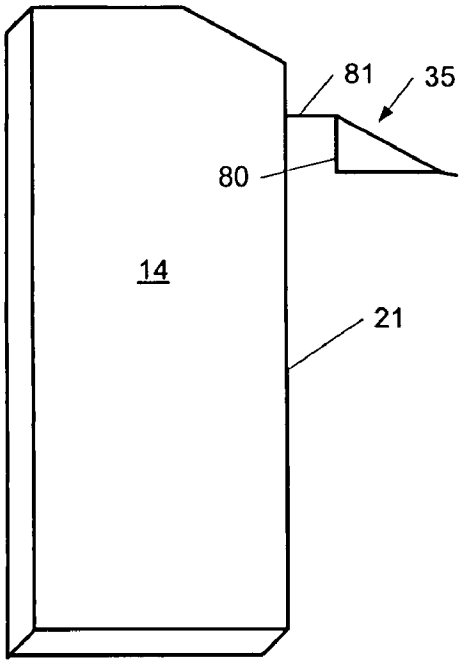
Figure 9D:
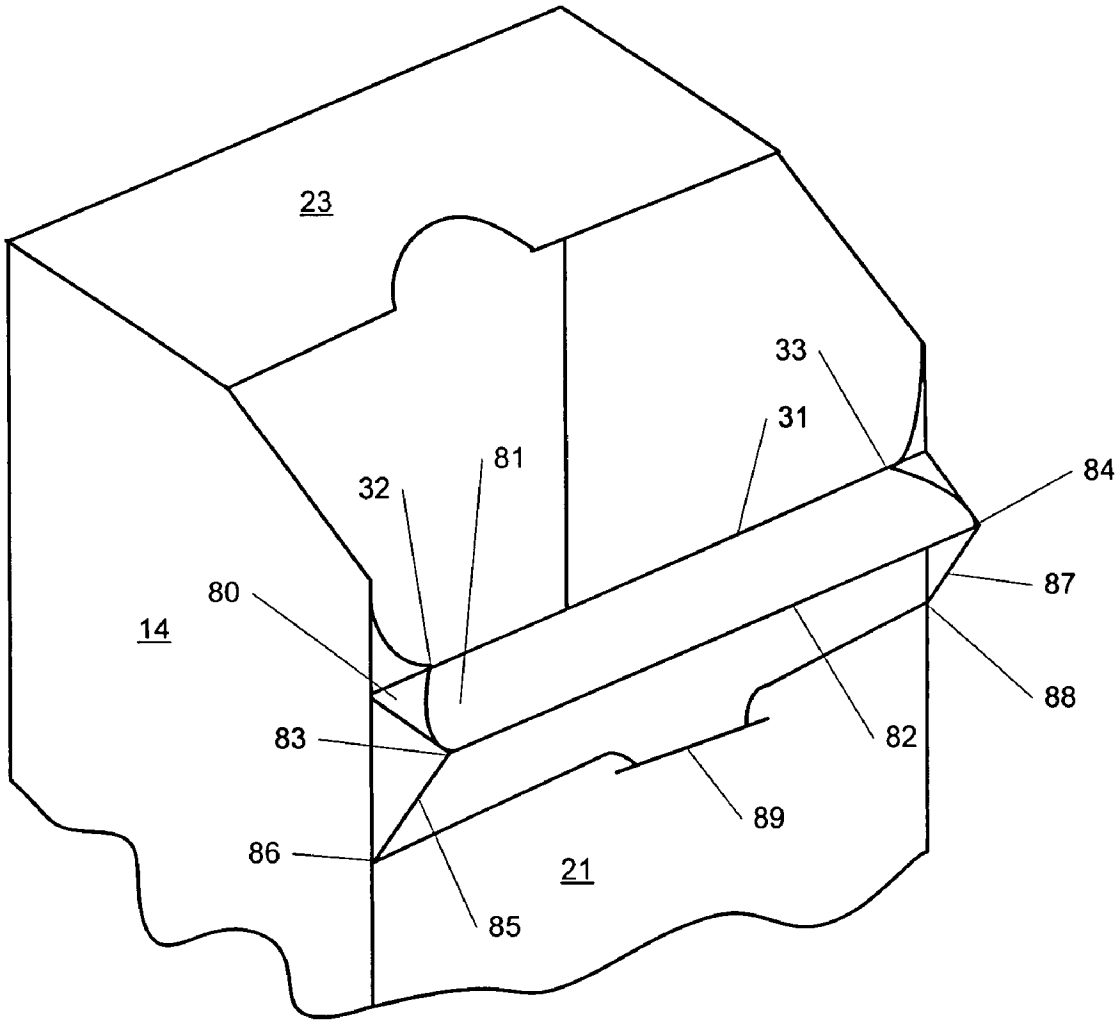
FIG. 9D is a perspective view, on an enlarged scale, of the bottom rearward end of the carton, showing the tilt assembly in its operable position.
Figure 11:
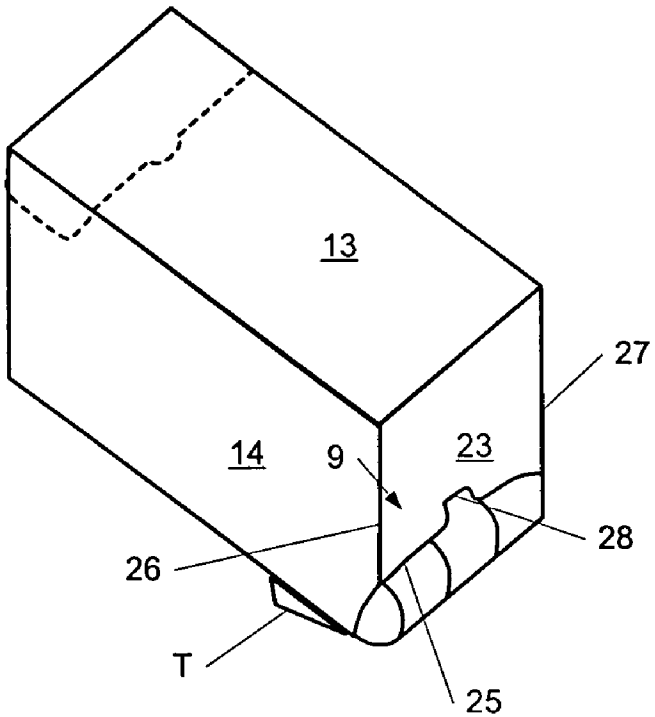
FIG. 11 is a perspective view of the rearward end of the carton containing PET bottles in a 2×6 arrangement showing the tilt assembly in its operable position.

FIG. 9A is a side view of carton C, showing flap 35 pulled so that line 25 is completely torn down to points 32 and 33. FIG. 9B shows the next step in engaging, or properly positioning, flap 35 in its operable position. In FIG. 9B, the portion of flap 35 comprised of end wall 23, as defined by line 25, is positioned to contact bottom wall 21. In this position of flap 35, panel 80 is spaced from, but adjacent, panel 81. FIG. 9C illustrates the final step in positioning the tilt assembly T, with panel 81 being pushed toward panel 80, until panels 80 and 81 contact one another. As shown in FIG. 9D, this position of flap 35 creates edge 82 (corresponding to line 30) which extends from point 83 to point 84. Angled edge 85 extends from point 83 to point 86 and angled edge 87 extends from point 84 to point 88. Tab 28 may be inserted into a slit 89 in bottom panel 21. Edges 82, 85 and 87 of tilt assembly T collectively provide support for carton C, when carton C thereafter is placed on the support surface SS. When tilt assembly T is placed in this operable position, the carton C is then gently allowed to rest back onto the support surface SS so that flap 35 is folded entirely beneath the carton, as shown in FIG. 11. In this manner, the tilt flap 35 becomes the rear support surface for the carton C, thereby raising the rearward end of carton C above the support surface SS. The containers having round or tubular side walls, therefore, tend to roll away from rear wall 23 and towards front wall 16 for positioning and easy removal, as described above. (For clarity of illustration, no containers are shown in FIG. 9D.)

Whenever desired, the tilt assembly T can be reclosed by reversing the order of the steps shown in FIGS. 9A to 9C, returning it to its original position.

Figure 12:
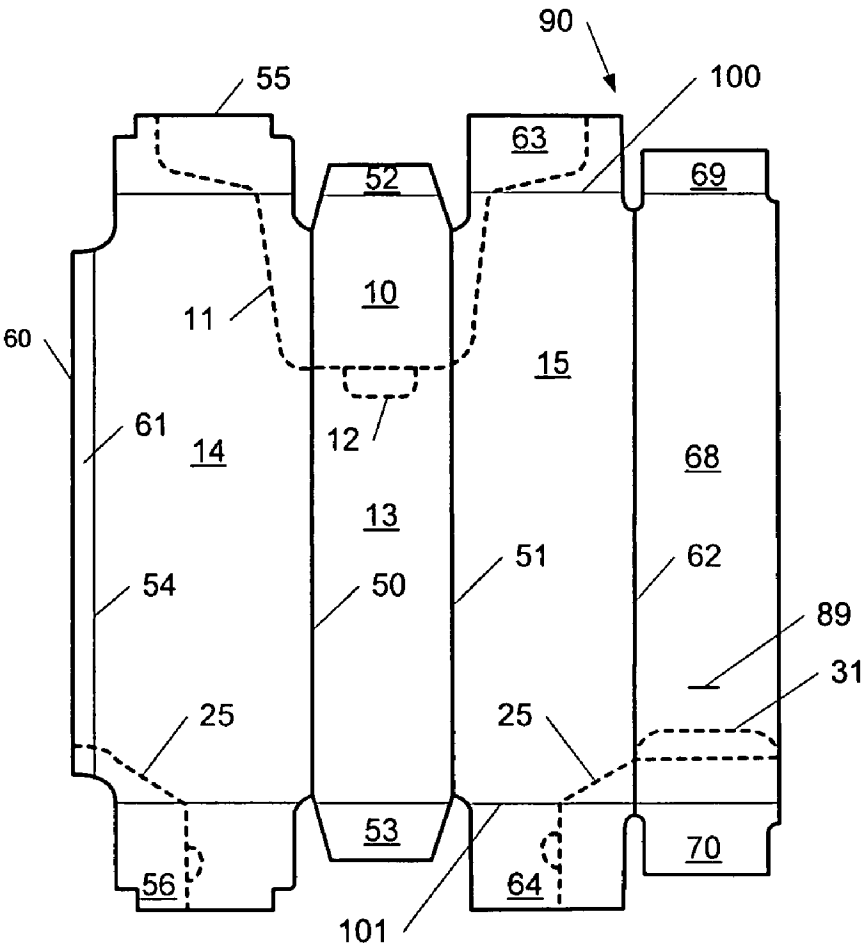
FIG. 12 is a plan view of a blank from which a carton according to this invention is formed.

The present invention also includes a carton blank 90 for making the carton C described above. The carton blank 90 shown in FIG. 12 is comprised of carrier board, such as SUS paperboard well known in the art, although the carton blank is not limited to any specific composition. For example, the blank also could be constructed of cardboard or of synthetic sheet material, such as plastic. The carton blank 90 includes crease or fold line 50 and fold line 51 that define top panel or wall 13 therebetween. Front top end flap 52 is defined at one end of top panel 13 and rear top end flap 53 is defined at the opposite end of panel 13. The flaps described herein also are known in the art as dust flaps. Fold line 54 is spaced from fold line 50 to define side panel 14 therebetween. At the front or forward end of side panel 14 is front side end flap 55, connected to side panel 14 by first transverse fold line 100, and at the opposite end or rear end of side panel 14 is rear side end flap 56, connected to side panel 14 by second transverse fold line 101. The carton blank defines a first free edge 60, which is spaced from and generally parallel to fold line 54 as shown in FIG. 12, to define fastening flap 61. Spaced from and parallel to fold line 51 is fold line 62, to define side panel 15 between fold lines 51 and 62. At the forward end of side flap 15 is front side end flap 63, connected to side panel 15 by first transverse fold line 100, and at the rearward end of side panel 15 is rear side end flap 64, connected to side panel 15 by second transverse fold line 101. The carton blank 90 also defines a second free edge 65 spaced from and generally parallel to fold line 62 as shown in FIG. 12. Bottom panel 68 is defined between fold line 62 and free edge 65. Front bottom end flap 69 is defined along the front portion of bottom panel 68, and rear bottom end flap 70 is defined at the rear portion of bottom panel 68. The blank is provided with score/cut line 11, perforated line 25 and fold line 31, so positioned and configured that when the carton is fully enclosed, as described below, these lines will define the previously-described dispenser 7 and tilt assembly T.

As known to those skilled in the art, carton blanks can be folded along the crease or fold lines to form a carton sleeve with fastening flap 61 overlapping and adhered to bottom flap 68. The carton blank 90 shown in FIG. 12 is folded in this manner to form the carton C of the present invention. A securing means such as a glue adhesive or compound is applied to flap 61 so that flap 61 is secured to flap 68 after the carton is folded, in order to form a sleeve. Also as known to those skilled in the art, once the carton C is formed into a sleeve, containers, such as the PET bottles or beverage cans depicted in the drawing figures are placed into the sleeve in the proper orientation. As shown, when the carton is fully enclosed and correctly inverted with top panel 13 being oriented upwardly, the containers lie on their respective sides.

The carton is fully enclosed by folding the end flaps described above to close the end portions, for example, by gluing the associated end flaps together to fully enclose the carton. The front end flaps cooperate to form front wall 16, and the rear end flaps cooperate to form rear wall 23.

Figure 13:
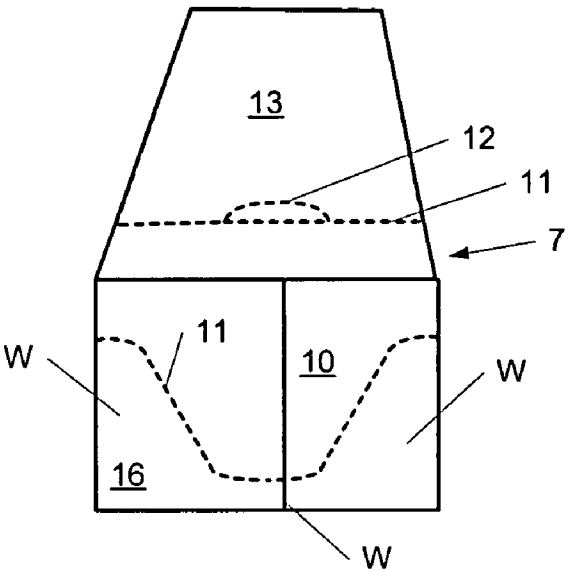
FIG. 13 is an end view of the carton containing cans.
Figure 15:
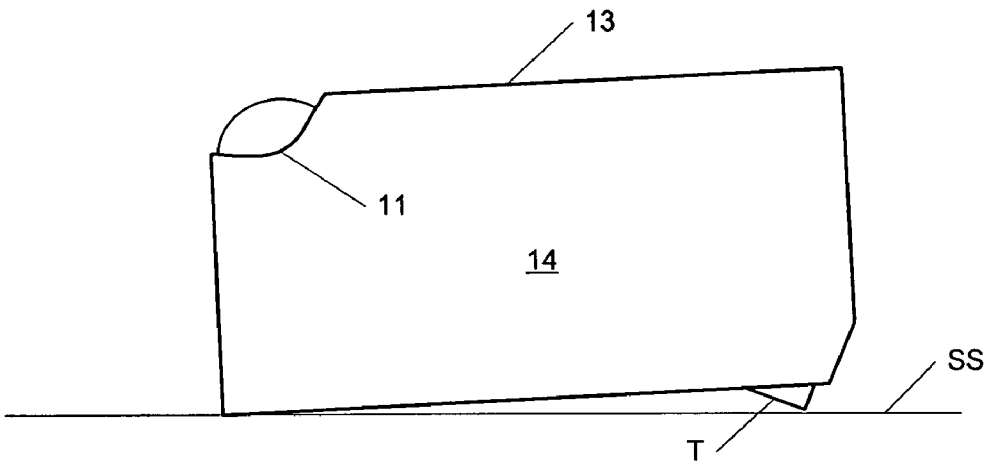
FIG. 15 is a side view of the carton of FIG. 13 containing cans in a 2×6 arrangement showing the dispenser removed and the tilt assembly in its operable position.
Figure 14:
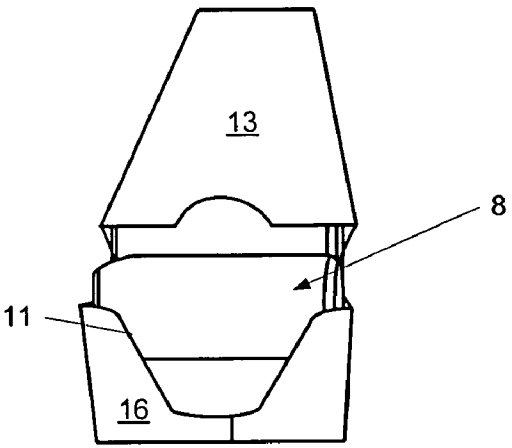
FIG. 14 is an end view of the carton of FIG. 13 containing cans in a 2×6 arrangement with the dispenser removed.

FIGS. 13-15 show the carton of the present invention as described above enclosing beverage cans instead of PET bottles. FIG. 13 is an end view of the carton containing cans. FIG. 13 shows retainer walls W, which prevent the articles in both the top and bottom rows of articles from unintentionally rolling out of the carton when the dispenser 7 is open. FIG. 14 is an end view of the carton of FIG. 13 containing cans in a 2×6 arrangement with the dispenser removed. FIG. 15 is a side view of the carton of FIG. 13 containing cans in a 2×6 arrangement showing the dispenser removed and the tilt assembly in its operable position.

The above specification represents the best mode known to the inventor of carrying out the invention. Since many modifications of the invention can be made without departing from the spirit and scope of the invention, the breadth and depth of the invention resides in the claims hereinafter appended.

I claim:

1. An enclosed carton for carrying a plurality of containers comprising:

a top panel, two side panels, a bottom panel, a first end, and a second end;

a positioning assembly at the second end which elevates the second end above the first end such that the containers move toward the first end; and the positioning assembly being a unitary structure which remains attached to the carton, the positioning assembly comprising a portion of the bottom panel, a portion of at least one of the side panels, and a portion of the second end; and an opening defined by a first tear line in at least the top panel and the first end;

wherein the positioning assembly is defined by a first fold line extending from a first point on the bottom panel to a second point on the bottom panel and a second tear line extending from the first point across the bottom panel, across the second end, and across the bottom panel to the second point.

2. The carton of claim 1, further comprising a second finger flap located along the second tear line for pulling the positioning assembly along the second tear line.

3. The carton of claim 2, wherein the second finger flap is located along the portion of the second tear line extending across the second end of the carton.

4. The carton of claim 1, wherein the portion of the carton defining the positioning assembly rises above the bottom panel less than the diameter of one of the containers.

5. The carton of claim 1, including a dispenser that can be opened to form the opening.

6. The carton of claim 5, wherein the dispenser is a unitary structure defined by the first tear line extending across the top panel, the two side panels, and the first end.

7. The carton of claim 6, wherein the distance between the first tear line and the bottom panel is less than the diameter of one of the containers and sufficient to prevent the containers from rolling out of the carton after the dispenser has been opened.

8. The carton of claim 6, further comprising a first finger flap located along the first tear line for opening the dispenser along the first tear line.

9. The carton of claim 8, wherein the first finger flap is located along the portion of the first tear line extending across the top panel of the carton.

10. The carton of claim 5, wherein the dispenser remains attached to the carton at the first end to form a basket upon opening the dispenser.

11. The carton of claim 5, wherein the dispenser is detached from the carton upon opening the dispenser.

12. The carton of claim 5, further comprising stopping means for preventing the containers from rolling out of the carton while the dispenser is open, the stopping means rising a distance above the bottom panel that is less than the diameter of one of the containers and that is sufficient to prevent the containers from rolling out of the carton while the dispenser is open.

13. The carton of claim 12, wherein the stopping means comprises a portion of the first end.

14. The carton of claim 12, wherein the stopping means preserves the structural integrity of the carton upon detachment of the dispenser from the carton.

15. The carton of claim 1, wherein each end comprises a top end flap, a bottom end flap, two side end flaps, and means for holding the flaps together.

16. The carton of claim 1, which is dimensioned to carry only two rows of containers, a top row and a bottom row, with each container in the top row being positioned directly above a corresponding container in the bottom row.

17. The carton of claim 1, wherein the positioning assembly is engaged by detaching the positioning assembly along the second tear line, and hinging the positioning assembly about the second fold line such that the positioning assembly contacts the bottom panel.

18. The carton of claim 17, wherein the containers will move toward the first end when the positioning assembly is engaged.

19. The carton of claim 17, wherein the carton maintains structural integrity when the positioning assembly is engaged.

20. The carton of claim 17, wherein the bottom panel further comprises a slit such that a portion of the positioning assembly may be inserted into the slit when the positioning assembly is engaged.

21. The carton of claim 1, further comprising a second fold line parallel to the first fold line, wherein the second fold line is defined by two points located on the portion of the second tear line extending across the bottom panel.

22. The carton of claim 21, wherein the positioning assembly is engaged by detaching the positioning assembly along the second tear line, hinging the positioning assembly about the first fold line, and hinging the positioning assembly about the second fold line such that the positioning assembly contacts the bottom panel.

23. The carton of claim 21, wherein the bottom panel further comprises a slit such that a portion of the positioning assembly may be inserted into the slit when the positioning assembly is engaged.

24. An enclosed carton for carrying a plurality of containers comprising:

a top panel, two side panels, a bottom panel, a first end, and a second end;

a positioning assembly at the second end which elevates the second end above the first end such that the containers move toward the first end; and the positioning assembly being a unitary structure which remains attached to the carton, the positioning assembly comprising a portion of the bottom panel and a portion of the second end; and an opening defined by a first tear line in at least the top panel and the first end;

wherein the positioning assembly is defined by a first fold line extending from a first point on the bottom panel to a second point on the bottom panel and a second tear line extending from the first point across the bottom panel, across one of the two side panels, across the second end, across the other side panel, and across the bottom panel to the second point.

25. The carton of claim 24, further comprising a second finger flap located along the second tear line for pulling the positioning assembly along the second tear line.

26. The carton of claim 25, wherein the second finger flap is located along the portion of the second tear line extending across the second end of the carton.

27. The carton of claim 24, wherein the portion of the carton defining the positioning assembly rises above the bottom panel less than the diameter of one of the containers.

28. The carton of claim 24, wherein the positioning assembly is engaged by detaching the positioning assembly along the second tear line, and hinging the positioning assembly about the second fold line such that the positioning assembly contacts the bottom panel.

29. The carton of claim 28, wherein the containers will move toward the first end when the positioning assembly is engaged.

30. The carton of claim 28, wherein the carton maintains structural integrity when the positioning assembly is engaged.

31. The carton of claim 28, wherein the bottom panel further comprises a slit such that a portion of the positioning assembly may be inserted into the slit when the positioning assembly is engaged.

32. The carton of claim 24, further comprising a second fold line parallel to the first fold line, wherein the second fold line is defined by two points located on the portion of the second tear line extending across the bottom panel.

33. The carton of claim 32, wherein the positioning assembly is engaged by detaching the positioning assembly along the second tear line, hinging the positioning assembly about the first fold line, and hinging the positioning assembly about the second fold line such that the positioning assembly contacts the bottom panel.

34. The carton of claim 32, wherein the bottom panel further comprises a slit such that a portion of the positioning assembly may be inserted into the slit when the positioning assembly is engaged.

35. A blank for forming an enclosed carton for carrying a plurality of containers comprising:

a sheet of foldable material having first, second, third and fourth parallel fold lines therein, defining a top panel, a first side panel, a second side panel, a bottom panel, and a fastening flap;

at one end of the parallel fold lines, a first fold line transverse to the parallel fold lines, the first transverse fold line connecting (a) a first side end flap to the first side panel and (b) a second side end flap to the second side panel;

at the other end of the parallel fold lines, a second fold line transverse to the parallel fold lines, the second transverse fold line connecting (a) a third side end flap to the first side panel and (b) a fourth side end flap to the second side panel;

a first tear line defining an opening in the top panel and the first and second side end flaps;

a first positioning fold line extending from a first point on the bottom panel to a second point on the bottom panel, the first positioning fold line being perpendicular to the parallel fold lines, but not intersecting any of the parallel fold lines;

a second tear line extending from the first point across the bottom panel and the second side panel to the second transverse fold line and across the fourth side end flap;

a third tear line extending from the second point across the bottom panel; and a fourth tear line extending across the fastening flap and the first side panel to the second transverse fold line and across the third side end flap.

36. The blank of claim 35, wherein the first side panel is defined by the first and second parallel fold lines, the top panel is defined by the second and third parallel fold lines, the second side panel is defined by the third and fourth parallel fold lines, the bottom panel is connected to the second side panel by the fourth parallel fold line, and the fastening flap is connected to the first side panel by the first parallel fold line; and wherein the bottom panel has a free edge opposite the fourth parallel fold line and the fastening flap has a free edge opposite the first parallel fold line.

37. The blank of claim 36, further comprising:

a second positioning fold line extending between a third point and a fourth point, the third point being defined by the intersection of the second tear line with the fourth parallel fold line, the fourth point being located on the free edge of the bottom panel; and a third positioning fold line extending between a fifth point and a sixth point, the fifth point being defined by the intersection of the fourth tear line with the first parallel fold line, the sixth point being located on the free edge of the fastening flap;

wherein the second and third positioning fold lines are parallel to the second transverse fold line;

wherein the distance between the second positioning fold line and the second transverse fold line is equal to the distance between the third positioning fold line and the second transverse fold line; and wherein the second positioning fold line is located between the first positioning fold line and the second transverse fold line.

38. The blank of claim 37, wherein the second positioning fold line is equidistant from the first positioning fold line and the second transverse fold line.

39. The blank of claim 35, wherein the first positioning fold line and the second, third and fourth tear lines define a unitary positioning assembly when the enclosed carton is formed from the blank, with the second, third and fourth tear lines being located such that a single tear line will be formed across the third and fourth side end flaps and the first and second side panels of the carton.

40. The blank of claim 35, wherein the first tear line extends across the top panel and the first and second side panels to the first transverse fold line and across the first and second side end flaps.

41. The blank of claim 40, further comprising a first finger flap located along the first tear line.

42. The blank of claim 41, wherein the first finger flap is located along the portion of the first tear line extending across the top panel.

43. The blank of claim 35, wherein the first tear line defines a unitary container dispenser when the enclosed carton is formed from the blank, such that a single tear line will be formed across the first and second side end flaps, the top panel and the first and second side panels of the carton.

44. The blank of claim 35, further comprising a second finger flap located along the second, third or fourth tear lines.

45. The blank of claim 44, wherein the second finger flap is located along the portion of the second tear line extending across the fourth side end flap and the portion of the fourth tear line extending across the third side end flap.

* * * * *